US009901150B2

(12) United States Patent
Fenton

(10) Patent No.: US 9,901,150 B2
(45) Date of Patent: Feb. 27, 2018

(54) CARRYING CASE WITH EXCHANGEABLE PANELS

(71) Applicant: James Randolph Fenton, Hermosa Beach, CA (US)

(72) Inventor: James Randolph Fenton, Hermosa Beach, CA (US)

( * ) Notice: Subject to any disclaimer, the term of this patent is extended or adjusted under 35 U.S.C. 154(b) by 0 days.

(21) Appl. No.: 14/121,066

(22) Filed: Jul. 25, 2014

(65) Prior Publication Data

US 2015/0083287 A1 Mar. 26, 2015

Related U.S. Application Data

(60) Provisional application No. 61/958,359, filed on Jul. 26, 2013.

(51) Int. Cl.

| | |
|---|---|
| ***A45C 3/00*** | (2006.01) |
| ***A45C 1/02*** | (2006.01) |
| ***A45C 3/06*** | (2006.01) |
| ***A45C 3/08*** | (2006.01) |
| ***A45C 11/00*** | (2006.01) |
| ***A45C 13/08*** | (2006.01) |
| ***A45F 3/04*** | (2006.01) |
| ***G10G 7/00*** | (2006.01) |
| ***G10D 1/08*** | (2006.01) |

(52) U.S. Cl.

CPC ..... *A45C 3/00* (2013.01); *A45C 1/02* (2013.01); *A45C 3/06* (2013.01); *A45C 3/08* (2013.01); *A45C 11/00* (2013.01); *A45C 13/08* (2013.01); *A45F 3/04* (2013.01); *G10D 1/08* (2013.01); *G10G 7/005* (2013.01); *A45C 2003/008* (2013.01); *A45C 2011/001* (2013.01); *A45C 2011/002* (2013.01); *A45C 2011/003* (2013.01); *Y10T 29/49826* (2015.01)

(58) Field of Classification Search

CPC .. A45C 13/42; A45C 5/14; A45C 3/00; A45C 1/02; A45C 3/06; A45C 3/08; A45C 11/00; A45C 13/08; A45C 2003/008; A45C 2011/001; A45C 2011/002; A45C 2011/003; A63B 55/40; G09F 7/12; G10D 1/08; G10G 7/005; Y10T 29/79826; A45F 3/04

See application file for complete search history.

(56) References Cited

U.S. PATENT DOCUMENTS 2,053,464 A * 9/1936 Dalsheim ..... A45C 3/06 150/105
2,068,058 A * 1/1937 Lewis ..... A45C 3/06 150/113
2,723,696 A * 11/1955 Kase ..... A45C 13/08 150/104
4,236,657 A * 12/1980 Brunton ..... A45F 3/04 190/111

(Continued)

*Primary Examiner* — Tri Mai

(57) ABSTRACT

A carrying case that may be configured to include or to receive an attachable panel is described. The attachable panel may be configured to be attached to the carrying case. The attachable panel may have graphical artwork or pictures printed onto its surfaces or otherwise affixed to it. The manufacturer of the attachable panel may not need to carry inventory of printed attachable panels, but instead may produce graphically enhanced attachable panels upon each sales order.

13 Claims, 12 Drawing Sheets

(56) References Cited

U.S. PATENT DOCUMENTS

| | | | | | |
|---|---|---|---|---|---|
| 4,649,974 | A * | 3/1987 | Takanashi | A45C 3/06 | 150/105 |
| 5,273,316 | A * | 12/1993 | Infante | B05B 15/0456 | 150/166 |
| 5,503,204 | A * | 4/1996 | Byers | A45C 3/08 | 150/103 |
| 5,560,479 | A * | 10/1996 | Leyba | A45C 13/42 | 206/315.3 |
| 6,029,723 | A * | 2/2000 | Baquero | A45C 3/08 | 150/105 |
| 6,749,062 | B1 * | 6/2004 | Meissner | A63B 55/406 | 206/315.3 |
| 2004/0026280 | A1 * | 2/2004 | Herold | G09F 7/12 | 206/315.3 |
| 2008/0238083 | A1 * | 10/2008 | Warford | A45C 13/42 | 283/81 |
| 2009/0008202 | A1 * | 1/2009 | Dayton | A45C 5/14 | 190/100 |
| 2010/0012238 | A1 * | 1/2010 | Lee | A45C 3/08 | 150/107 |
| 2010/0252152 | A1 * | 10/2010 | Stupski | A45C 13/08 | 150/105 |

* cited by examiner

FIG. 9
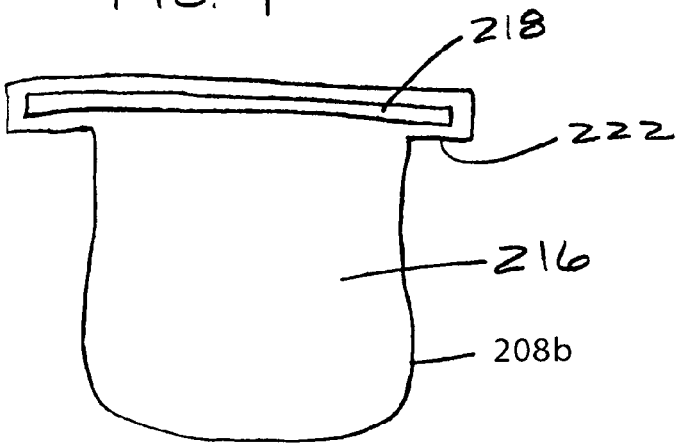
FIG. 10
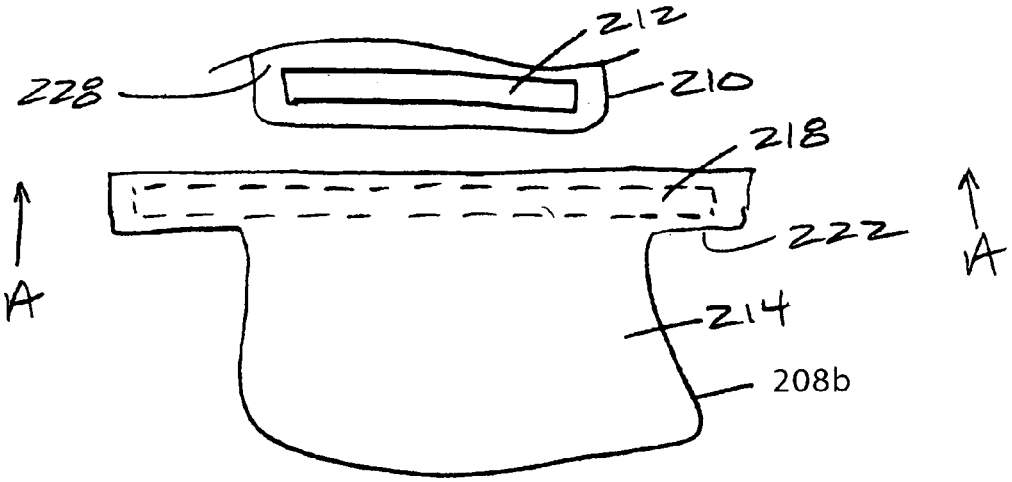
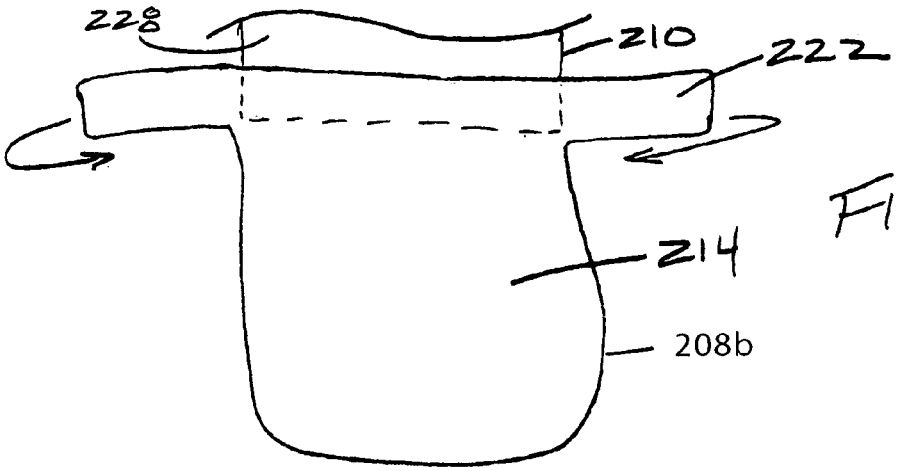
FIG. 11

FIG. 13
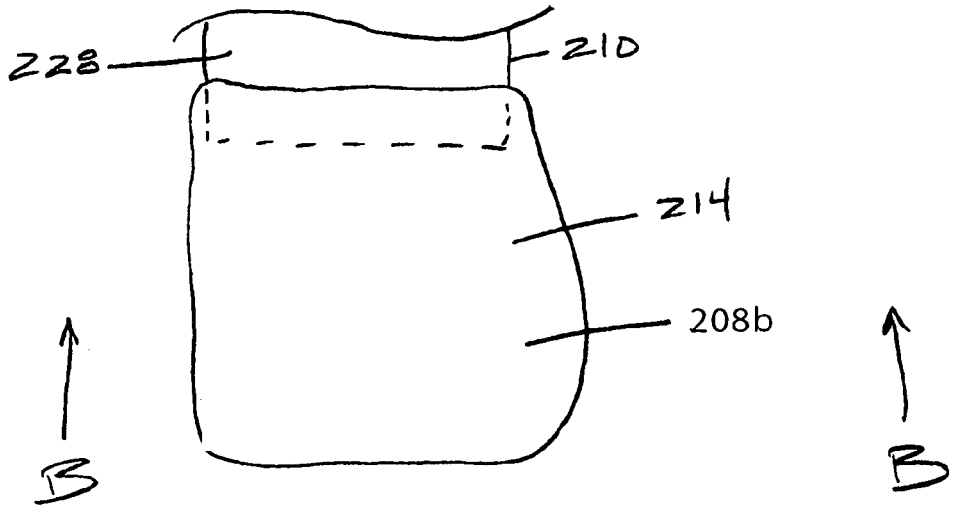
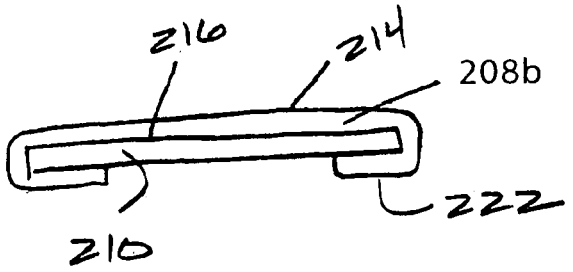
FIG. 14
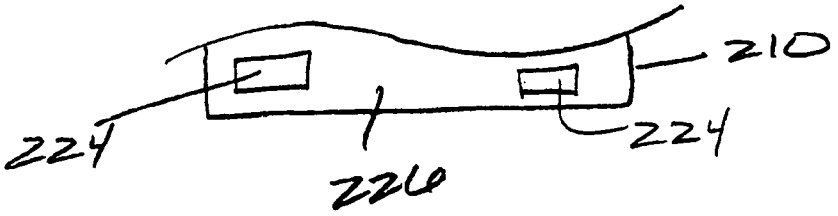
FIG. 12

FIG. 15
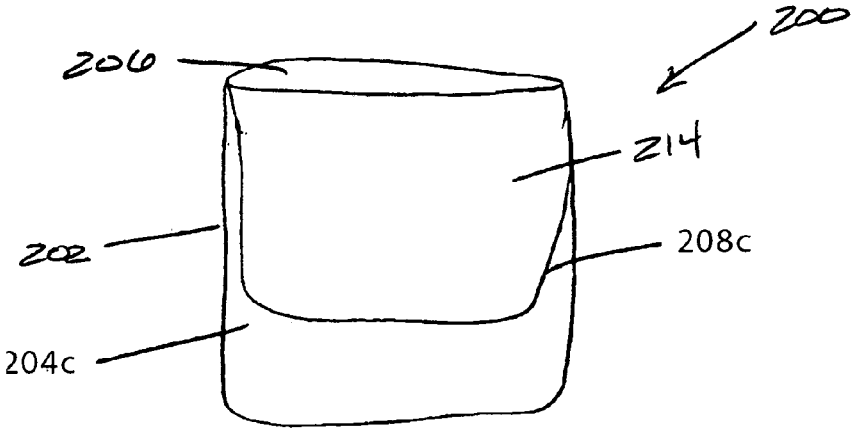
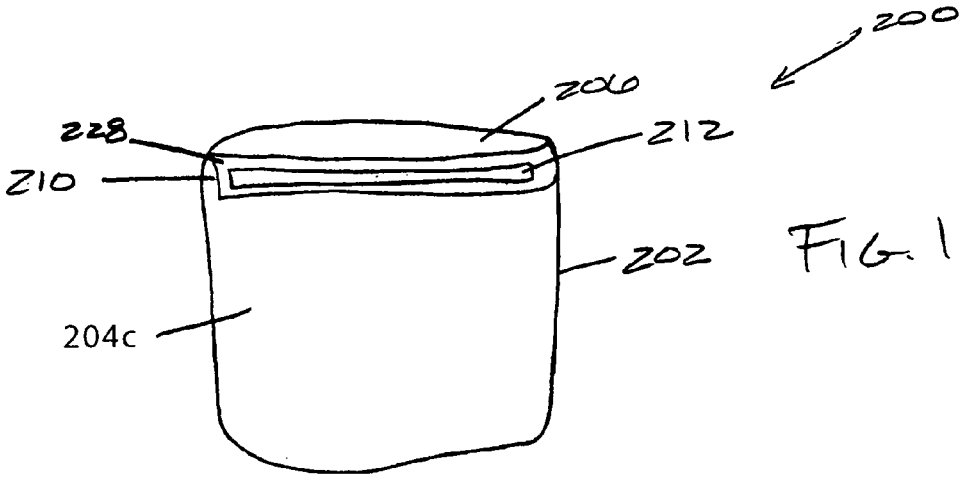
FIG. 16
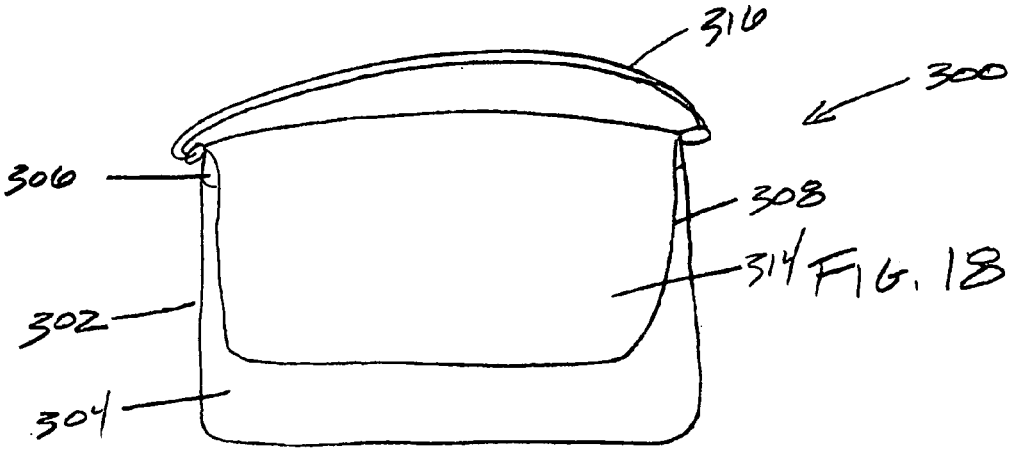
FIG. 18

CARRYING CASE WITH EXCHANGEABLE PANELS

This application claims priority from U.S. Provisional Patent Application Ser. No. 61/958,359, filed on Jul. 26, 2013, the entireties of which are expressly incorporated by reference herein.

FIELD OF THE INVENTION

The field of the invention generally relates to carrying bags and cases. More specifically, the invention relates to carrying bags that may have attachable, removable and exchangeable outer panels with printed graphics or pictures.

The field of the invention also generally relates to the manufacturing of attachable panels for carrying cases upon each sales order without the need to carry inventory of pre-printed attachable panels.

BACKGROUND OF THE INVENTION

There are many different types of carrying bags and cases on the market in the world. Some examples are 1) backpacks that may be used by students or others to carry books and other supplies, 2) business and computer bags used to carry laptops and other business supplies, 3) sports bags used to carry sporting goods, 4) musical instrument bags used to carry musical instruments and 5) travel bags and luggage to carry personal belongings. In addition to these examples, there are many other types of carrying bags on the market throughout the world.

In one example, musical instrument carrying bags and cases typically come in a variety of shapes and sizes depending on the types of musical instrument they are designed to hold. The bags and cases may also come in a variety of types, specifically, hard, soft, or hybrid type cases. Hard cases may comprise an outer shell that is hard and rigid, and may be made of harder materials such as plastic, metal such as aluminum, pressed leather or other harder materials. Soft cases, often referred to as gig bags, may comprise an outer shell that is softer and less ridged than a hard case, and may be made of softer materials such as polyester fabric, nylon fabric, canvas, softer leather or other materials. Often, these softer materials may be lined with a thin PVC or PU lining in order to add a small level of rigidity and durability to the shell. Hybrid cases are typically a combination of a hard case and a soft case, and may utilize a softer outside shell with a more rigid inner padding to increase the level of protection that the bag may provide to the musical instrument.

The cases and bags often also include a layer of foam padding on the interior of the case or bag on one or more sides to provide increased protection to the musical instrument that may be contained inside. The foam padding may protect the musical instrument inside the case if the case were to be dropped or were to receive a blow from a blunt object. The cases and bags often also include pockets on the front panel of the bag or case to carry musical sheets and binders, as well as other accessories such as picks, cords and straps. In addition, many musical instrument carrying bags and cases include side handles to carry the bag or case with one hand, and back pack straps on the back of the bag to secure the bag over the user's shoulders as a backpack would be secured and carried.

Many musical instrument bags and cases on the market currently are made of a single colored material, predominantly black. Others may use materials of other colors and a few may have colored graphics printed on the bags. However, these bags and cases are typically limited in variety and the colors and graphics are applied to the bags in a permanent fashion; that is, the colors and the graphics cannot be removed or changed.

It should be noted that creative people such as musicians may wish to express themselves and their own unique personalities by having graphics and artwork on their musical instrument bags and cases. However, there are no musical instrument bags that allow the user to apply a wide variety of graphics to the bags, or that allow the user themselves to apply their own colorful graphics or logos to the bags in a high quality manner.

In addition, the user may wish to express themselves with a particular graphic or logo on their bag one day, and then may wish to express themselves differently the next day with a different graphic or logo on their same bag. However, there are no musical instrument bags or cases that allow the user to change the graphics or logos on the bag or case as desired. In addition, having multiple bags that may have different graphics that may be used to express themselves differently may become costly due to the high cost of the bags. Also, musical cases and bags are often somewhat large, and having multiple bags may require a large amount of storage space to store the different bags when not in use.

The same may be said for other types of carrying bags such as backpacks, business and computer bags, sports bags, travel bags and other types of carrying bags. That is, the owners of these types of bags, as well as other types of bags not mentioned, may also be interested in expressing themselves with graphics and artwork on their carrying bags similar to musicians with their musical bags. And they too may wish to express themselves with one particular graphic design on their carrying bag on one day and a different graphical design on their carrying bag on another day.

From a manufacturing and business standpoint, it may be costly for a manufacturer of carrying bags to produce inventories of carrying bags with particular designs on them to sell to retail outlets and direct to customers. It may also be risky for a manufacturer of carrying bags to pick one or several designs to produce and to produce inventories of these particular designs in hopes that the carrying bags with these particular designs will be popular designs and will sell. If the designs are not popular, or fall out of popularity before the entire inventory is sold, the manufacturer may be stuck holding inventory of carrying bag designs that are no longer sellable and may be required to liquidate the inventory at a financial loss.

Accordingly, there is a need for an improved carrying bag or case of different types as described above that addresses the foregoing and other issues.

SUMMARY OF THE INVENTION

The present invention addresses the foregoing and other shortcomings of existing carrying cases.

One aspect of the present invention regards an instrument carrying case that may be configured to utilize an attachable front panel.

Another aspect of the current invention regards Velcro or other attachment means for an instrument carrying case to be configured with an attachable panel.

Another aspect of the current invention regards an attachable panel that may be configured to attach to a carrying case.

Another aspect of the current invention regards Velcro or other attachment means for the attachable panel to be secured to the carrying case.

Another aspect of the current invention regards having Velcro around the circumference of the front side of the carrying case and around the circumference of the back side of the attachable panel so that the Velcro sections may mate.

Another aspect of the current invention regards to having Velcro in other areas on the carrying case and in other areas on the attachable panel so that the Velcro sections may mate.

Another aspect of the current invention regards the attachable panel being easily removed from the carrying case and exchanged with a different attachable panel that may be attached to the carrying case.

Another aspect of the current invention regards having graphical artwork or pictures printed or otherwise affixed to the attachable panel.

In another aspect of the current invention, the attachable panel may resemble the size and shape of the side of the carrying case to which it may be attached.

In another aspect of the current invention, the attachable panel may not resemble the size and shape of the side of the carrying case to which it may be attached.

In another aspect of the current invention, attachable panel may cover the entire side of the carrying case to which it may be attached.

In another aspect of the current invention, attachable panel may cover up only a portion of the side of the carrying case to which it may be attached.

In another aspect of the current invention, multiple attachable panels may be attached to one or multiple sides of the carrying case.

In another aspect of the current invention, snaps may be used to secure attachable panel to the carrying case.

In another aspect of the invention, zippers may be used to secure attachable panel to the carrying case.

In another aspect of the current invention, other means such as latches, clips, buttons or other means may be used to secure attachable panel to the carrying case.

In another aspect of the current invention, the attachable panel may serve as the front panel of the carrying case.

Another aspect of the current invention relates to a backpack that may be configured to utilize an attachable panel.

Another aspect of the current invention relates to an attachable panel that may be secured to a backpack.

Another aspect of the current invention relates to an attachable panel utilizing additional side flaps to attach to a backpack.

Another aspect of the current invention relates to a messenger bag that may be configured to utilize an attachable panel.

Another aspect of the current invention relates to an attachable panel that may be secured to a messenger bag.

Another aspect of the current invention relates to a duffle bag that may be configured to utilize an attachable panel.

Another aspect of the current invention relates to an attachable panel that may be secured to a duffle bag.

In another aspect of the current invention, the carrying bag may include one, two or more top openings.

In another aspect of the current invention, the attachable panel may cover one, two or more top openings.

In another aspect of the current invention, other types of carrying bags may be configured to utilize an attachable panel.

In another aspect of the current invention, an attachable panel may be configured to be secured to other types of carrying bags.

In another aspect of the current invention, an existing carrying bag may be retrofitted to utilize an attachable panel.

In another aspect of the current invention, an attachable panel may be configured to be attached to a retrofitted carrying bag.

In another aspect of the invention, an attachable panel may be modified to be configured to be attached to a retrofitted carrying bag.

In another aspect of the current invention, Velcro may be used to attach an attachable panel to a retrofitted carrying bag.

In another aspect of the current invention, other attachment means may be used to attach an attachable panel to a retrofitted carrying bag.

In another aspect of the invention, the shape and size of an attachable panel may be modified to fit onto a retrofitted carrying bag.

In another aspect of the current invention, graphical designs and pictures may be available for a customer to choose to have printed onto an attachable panel.

In another aspect of the current invention, graphic artwork tools may be provided to the customer to create artwork that may be printed onto the attachable panel.

In another aspect of the current invention, customers may provide their own graphical artwork or pictures to the manufacturer to be printed onto that attachable panel.

In another aspect of the current invention, means for a customer to provide the manufacturer their graphical artwork and pictures while at a retail store may be provided.

In another aspect of the current invention, other artists may create graphical artwork or pictures to be provided to customers to choose to have printed onto attachable panels.

In yet another aspect of the current invention, other companies may provide advertising and marketing images to the manufacturer to have printed onto the attachable panels.

In yet another aspect of the invention, graphical artwork and pictures may be printed onto the attachable panels using a dye sublimation system.

In another aspect of the current invention, a pad may be used underneath the attachable panel while using a dye sublimation system.

In another aspect of the current invention, the manufacturer of attachable panels may not need to carry inventory of pre-printed attachable panels.

In yet another aspect of the invention, the manufacturer may print graphical artwork or pictures on that attachable panels using just in time manufacturing.

In yet another aspect of the current invention, carrying cases configured to utilize attachable panels may be sold in retail stores, online and in other places.

In yet another aspect of the current invention, attachable panels may be sold in retail stores, online or in other places.

In another aspect of the current invention, attachable panels may be sold either alone or with a carrying bag In another aspect of the current invention, attachable panels may be sold that contain artwork created by the manufacturer, artwork created by the customer, artwork created by other artists, artwork created by other companies, or artwork created by other sources.

BRIEF DESCRIPTION OF THE DRAWINGS

FIG. 9 is a view of the back side of an attachable panel with upper side flaps configured for a backpack.

FIG. 10 is a view of the first step of alignment for the attachment of an attachable panel to a backpack.

FIG. 11 is a view of the attachment procedure of an attachable panel with upper side flaps to a backpack.

FIG. 12 is a view of the backside of an upper flap on the backpack positioned behind the top opening.

FIG. 13 is a front view of an attachable panel with upper side flaps attached to an upper flap on the backpack.

FIG. 14 is a side view of an attachable panel with upper side flaps attached to an upper flap on the backpack.

FIG. 15 is a view of an attachable panel attached to a backpack in front of the backpack top opening.

FIG. 16 is a view of upper flap on a backpack positioned in front of the top opening.

FIG. 18 is a view of a messenger bag with an attachable panel.

DETAILED DESCRIPTION OF THE PREFERRED EMBODIMENTS

There are many different types of carrying bags and cases being sold throughout the world. Examples of these different types of carrying cases and bags include musical instrument bags and cases, backpacks, laptop bags and cases, business cases, purses, phone cases, tablet computer cases, travel cases and luggage, sports bags and many other types of carrying bags and cases. Because there are so many different types of bags and cases on the global market, this specification will begin by describing the invention as it relates to musical instrument carrying bags and cases, specifically guitar bags and cases, and will then continue with a description of how the invention relates to other types of carrying cases and bags such as backpacks, messenger bags, sports bags, business and computer bags, purses, travel bags and other types of carrying bags.

Figure 1:
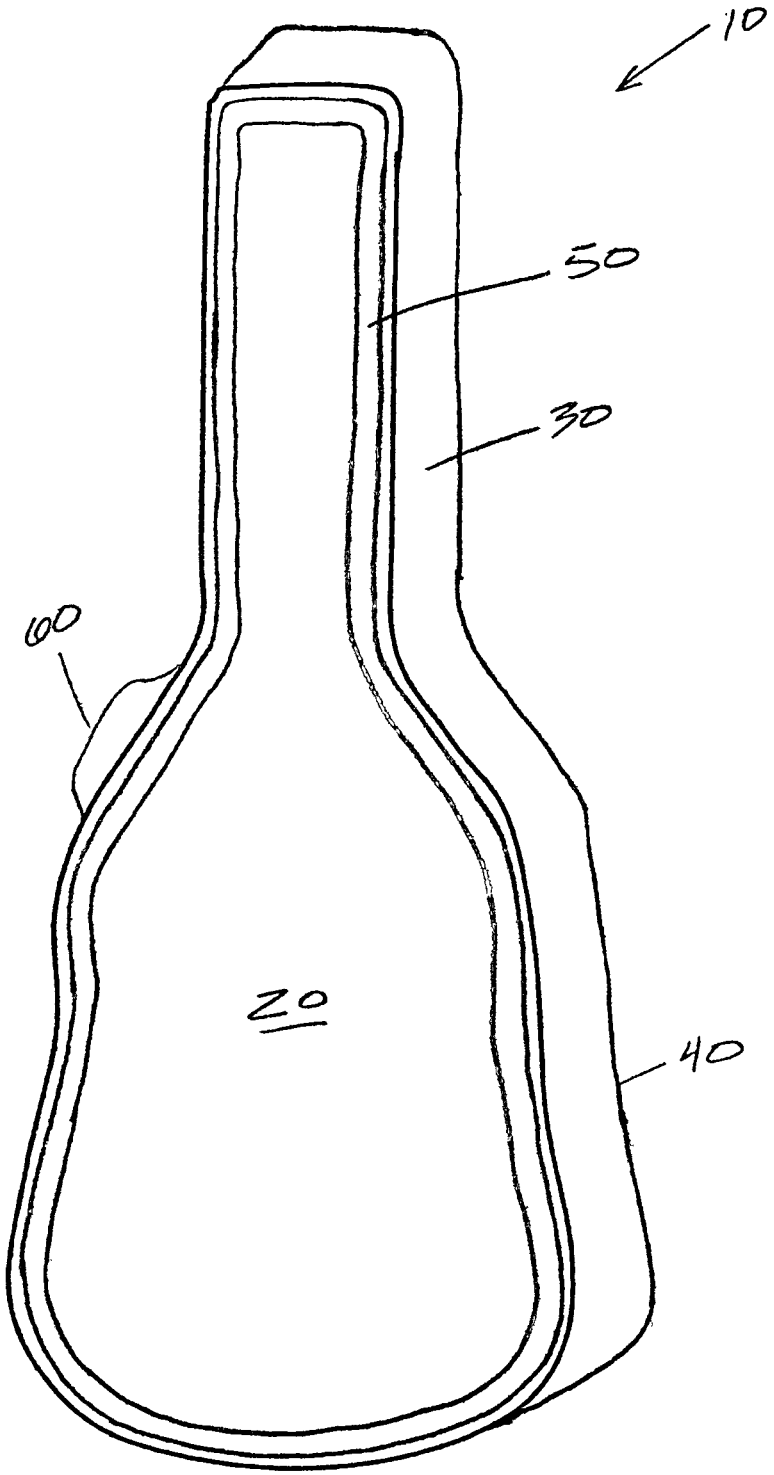
FIG. 1 is a view of the front of an instrument carrying bag configured to receive an attachable panel.

A preferred embodiment of the current invention is now described with reference to FIG. 1. FIG. 1 shows a front view of a case or bag 10 that may be designed to carry a guitar. The guitar may be an acoustic guitar, an electric guitar or other type of guitar. Components appearing in more than one figure are identified by the same reference numeral.

Figure 4:
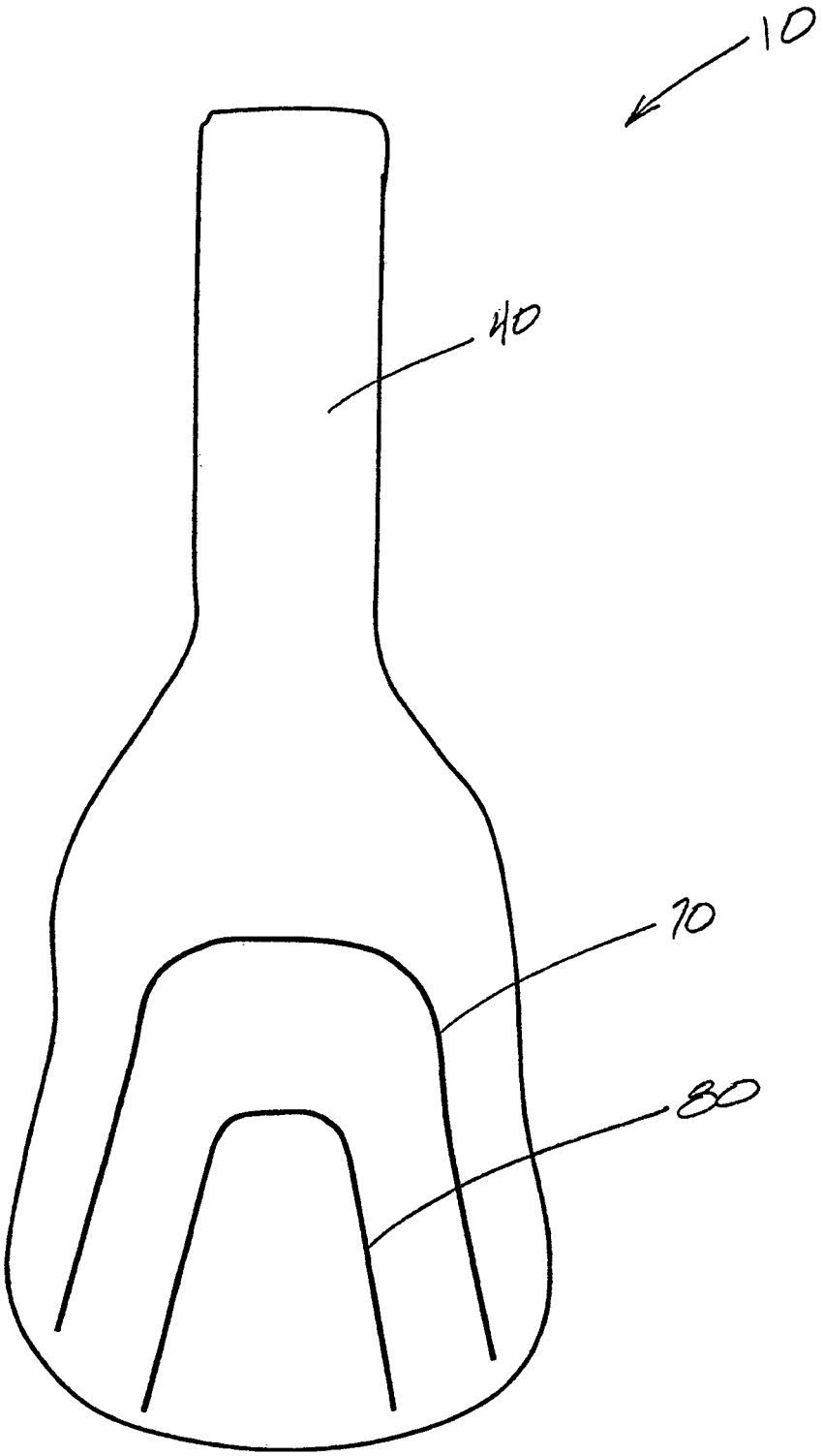
FIG. 4 is a view of the back of an instrument carrying bag with pockets.
Figure 5:
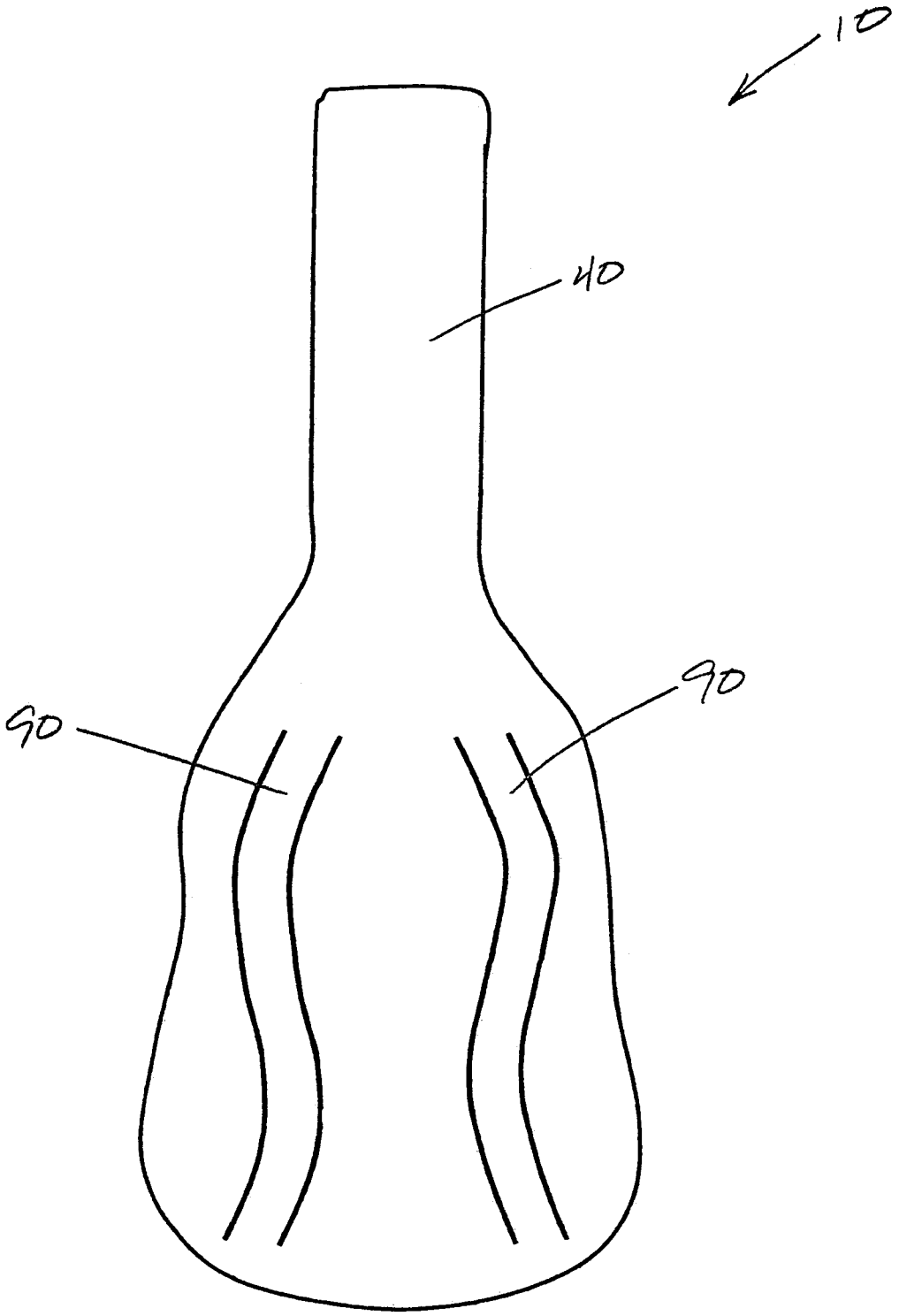
FIG. 5 is a view of a back of an instrument carrying bag with backpack straps.

As shown in FIG. 1, FIG. 4 and FIG. 5, guitar bag 10 may include front panel 20, side panel 30, back panel 40, front Velcro section 50, side handle 60, pockets 70, 80 and backpack straps 90.

Guitar bag 10 may be generally configured to receive a musical instrument such as a guitar in order to protect the instrument during travel or storage, and may provide holding means for the user to carry the bag such as side handle 60, backpack straps 90 or other means. In addition, front panel 20 may include a side zipper (not shown) that may be opened in order to partially or fully separate front panel 20 from side panel 30 in order to insert the guitar into the bag 10, and that may be closed to secure the instrument inside. As shown in FIG. 5, guitar carrying case may include backpack type straps on the back of the bag 10 such that the guitar carrying case 10 may be worn like a backpack for hands-free carrying. Pockets 70, 80 as shown in FIG. 4 may be configured on the back of the guitar carrying case as shown to hold items such as sheet music, tablet and laptop computers, cables, picks and other accessories and items. While pockets 70, 80 are shown to be located on the back of the guitar carrying bag in order to leave the front side 130 of the carrying case free of these elements, pockets may also be located in other areas and on other sides of guitar carrying case 10.

In one embodiment as shown in FIG. 1, Velcro section 50 may include a strip of either Velcro loop fastener material or Velcro hook fastener material that may be sewn or attached by other means around the general circumference of front panel 20. While this specification describes the hook and loop fastener material as Velcro brand, other manufactures of fastening material may also be used. In a preferred embodiment, Velcro strip 50 may be 0.5 inches wide, but other widths may also be used.

Figure 2:
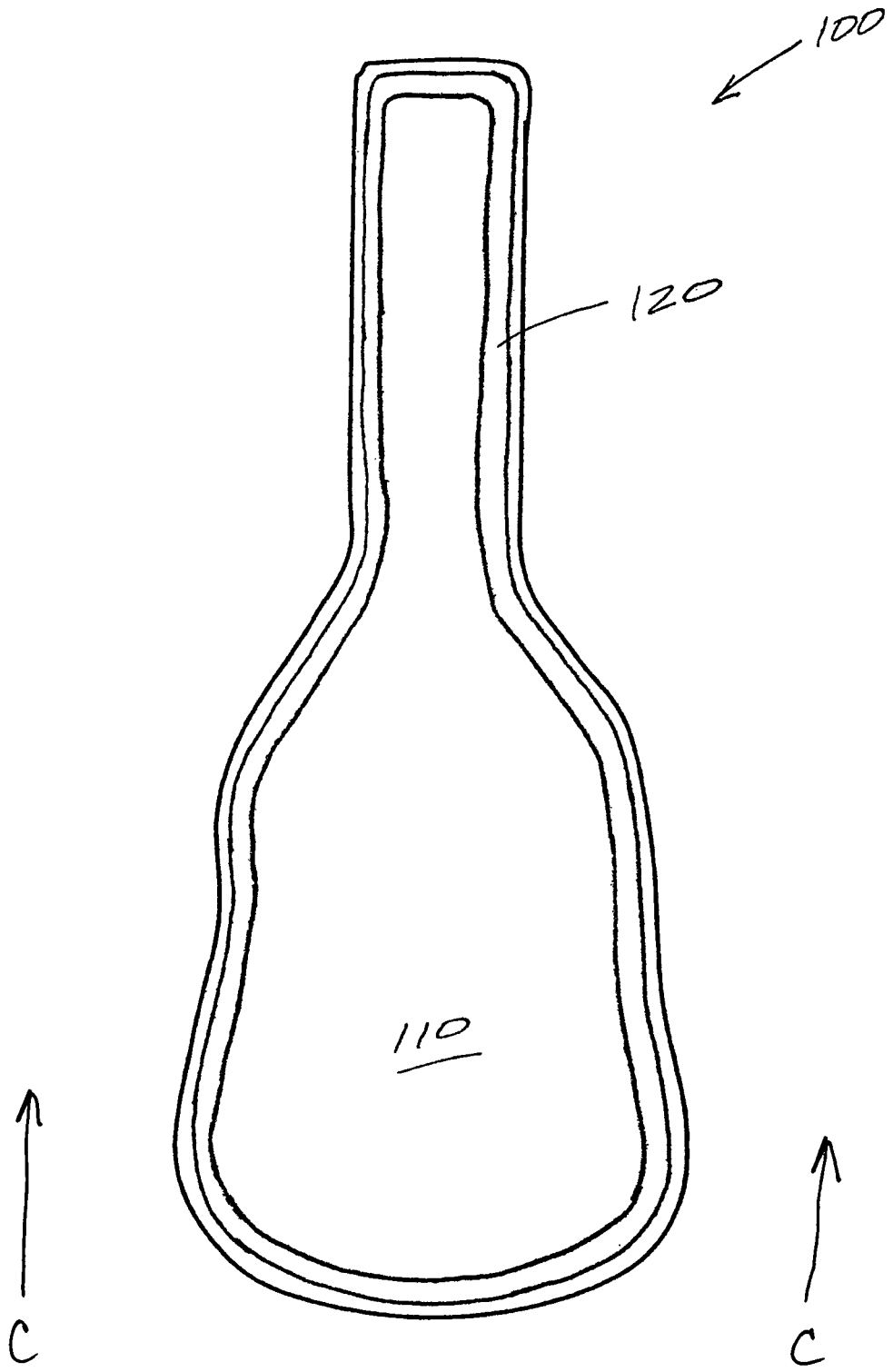
FIG. 2 is a view of the back of an attachable panel configured for an instrument carrying bag.

Velcro section 50 may be configured to receive and attach to Velcro section 120 that may be sewn or attached by other means around the general circumference of back side 110 of attachable panel 100 as shown in FIG. 2. As will be described in further detail in later sections, attachable panel 100 may have a front side 130 (not shown) and a back side 110 that may generally correspond in size and shape to front panel 20 of bag 10. In addition, attachable panel 100 may comprise of a rugged material similar to the material used to manufacture the instrument bag such as polyester, nylon, canvas or other materials. Also, attachable panel 100 may include a liner material adhered to its back side 110 that may add stiffness to the attachable panel 100. In a preferred embodiment, front side 130 of attachable panel 100 may contain graphics, pictures or other artwork that may be chosen or created by the user in order to express themselves through aesthetic means.

Attachable panel 100 may be secured to front panel 20 of gig bag 10 by placing attachable panel 100 onto front panel 20 such that Velcro section 50 and Velcro section 120 may generally align face-to-face, and by pressing Velcro section 120 onto Velcro section 50 such that they may mate and adhere to one another. It may be preferable that if Velcro section 50 may be a loop type of Velcro fastener, that Velcro section 120 may be a hook type of Velcro fastener such that the two Velcro sections may mate and adhere to one another when aligned and pressed together. It may also be preferable that if Velcro section 50 may be a hook type of Velcro fastener, that Velcro section 120 may be a loop type of Velcro fastener such that the two Velcro sections may mate and adhere to one another when aligned and pressed together.

As shown in the illustrated embodiment of FIG. 1, Velcro section 50 may be a generally continuous strip of Velcro fastening material that may extend around the general circumference of front panel 20 of guitar bag 10. While FIG. 1 shows Velcro section 50 as extending continuously around the general circumference of the front panel 20, the Velcro section 50 may not be continuous and may be in sections.

In addition, Velcro section 50 may be sewn or otherwise attached to other locations on front panel 20 such as in the inner region instead of along the circumference. Also, Velcro strip 50 may be located in a variety of locations that may include the circumference, the inner regions and other regions of front panel 20.

While FIG. 1 depicts Velcro section 50 as generally being a strip, other shapes or patterns of Velcro may be used such as square patches, circular patches, and other shapes or patterns of Velcro that may be located in various locations on front panel 20.

In addition, as shown in FIG. 2, Velcro section 120 may be a generally continuous strip of Velcro fastening material that may extend around the general circumference of back side 110 of attachable panel 100. While FIG. 2 shows Velcro section 120 as extending continuously around the general circumference of the back panel 110 of attachable panel 100, the Velcro section 120 may not be continuous and may be in sections.

Also, Velcro section 120 may be sewn or otherwise attached to other locations on back side 110 of attachable panel 100 such as in the inner region instead of along the circumference. Also, Velcro strip 120 may be located in a variety of locations that may include the circumference, the inner regions and other regions of back side 110 of attachable panel 100.

While FIG. 2 depicts Velcro section 120 as generally being a strip, other shapes or patterns of Velcro may be used such as square patches, circular patches, and other shapes or patterns of Velcro that may be located in various locations on back side 110 of attachable panel 100.

It may be preferable that at least some of the Velcro sections 120 on back side 110 of attachable panel 100 may align with at least some of the Velcro sections 50 on front panel 20 of bag 10 when attachable panel 100 is generally placed onto front panel 20 of bag 10 and the shape of attachable panel 100 is generally aligned with the shape of front panel 20 of bag 10. In this generally aligned position, attachable panel 100 may be pressed onto front panel 20 of bag 10 such that such that at least some of the Velcro sections 50 on front panel 20 of bag 10 may mate and adhere to at least some of the Velcro sections 120 on the back side 110 of attachable panel 100. In this configuration attachable panel 100 may be secured to the front face 20 of the instrument bag 10. The resulting combination of the back side 110 of attachable panel 100 mated and secured to the front panel 20 of instrument carrying bag 10 as described above is shown in FIG. 3.

Figure 3:
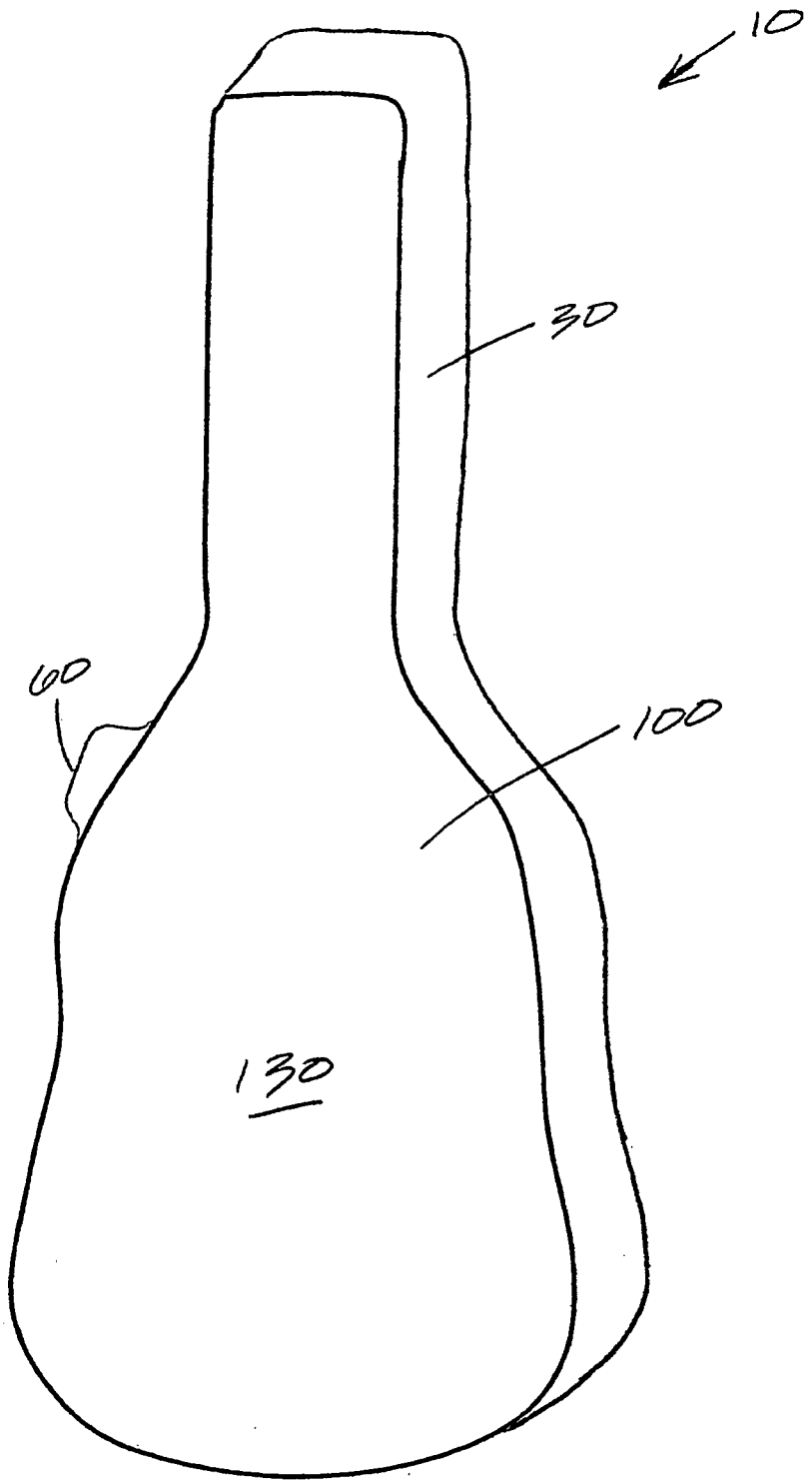
FIG. 3 is a view of a front of an instrument carrying bag with attachable panel.

As shown in FIG. 3, the front side 130 of attachable panel 100 may be exposed and may generally cover the front panel 20 of instrument bag 10. In this configuration, front side 130 of attachable panel 100 may contain graphical artwork, logos, printed pictures, or other types of images (not shown) that may be used to add aesthetic value to the instrument bag.

It should be noted that attachable panel 100 may be removed by pulling the attachable panel 100 away from front face 20 of gig bag 10 with adequate force to break the mating bond between Velcro sections 50 and 120. In this way, one attachable panel 100 that may have specific graphical artwork printed on its front side 130 may be removed and replaced with another attachable panel 100 that may have different graphical artwork printed on its font side 130. The procedure to do this may be for the user to pull an existing attachable panel 100 off the front panel 20 of bag 10 by gripping attachable panel 100 and pulling it away from the front panel 20 of bag 10 to release attachable panel 100 from bag 10. The user may then generally align the shape of a new attachable panel 100 with the shape of front panel 20 of bag 10 and may press attachable panel 100 to front panel 20 of bag 10 to attach new attachable panel 100 to bag 10. In this fashion, the user may remove and replace attachable panels 100 as they desire in order to change the graphical design shown on their carrying case at any time. The user may also purchase or otherwise acquire additional attachable panels 100 with brand new designs at any time to continually increase the selection of designs that they may attach to their carrying cases and bags.

It should also be noted that while FIG. 3 shows the attachable panel 100 as generally resembling the size and shape of front panel 20 of instrument bag 10, attachable panel 100 may not generally resemble the size and shape of front face 20 (not shown). In one example of this type, attachable panel 100 may cover only a portion of front face 20 and may therefore be any shape. In this embodiment it may be preferable that attachable panel 100 may fit generally within the entire or a portion of the outer contour of front face 20 but this may not be required. It may also be preferable that attachable panel 100 not extend past the outer circumference of front face 20 of bag 10, but this may not be required. In addition, attachable panel 100 may be modified to fit within the contour of front panel 20 by folding, cutting or other modification techniques.

Graphical artwork may be printed on or otherwise affixed to the front side 130 of attachable panel 100 using a digital printing machine, a dye sublimation system, silk screening techniques, paint, decals, stickers or other means so that the customer may express themselves aesthetically through the artwork they choose for their bag.

While the descriptions thus far of the attachable panel 100 of FIG. 2 and the instrument bag 10 of FIG. 1 have mainly described the attachable panel 100 being removably attached to the front panel 20 of the instrument bag 10 by using Velcro fastening means, other means such as clips, pins, buttons, snaps, zippers, latches, grommets, magnets or other means may also be used. In these examples, the fastening means may be a part of the instrument bag 10 and the attachable panel 100 as described above with respect to using Velcro as the attachment means. Or, the attachment means may be a part of the instrument bag 10 only, the attachable panel 100 only, neither the bag 10 nor the attachable panel 100, or any combination thereof. In addition, the fastening means may or may not remain as a part of the bag 10 or the attachable panel 100 when the attachable panel 100 may be removed.

For instance, in one embodiment, attachable panel 100 may be attached to the front panel 20 of bag 10 using a side zipper. That is, one side of the zipper may be attached around the general circumference of the attachable panel 100 and the other side of the zipper may be attached around the general circumference of the front panel 20 of the bag 10 such the two sides of the zipper may be zipped together to secure attachable panel 100 to the front panel 20 of bag 10. In addition, the zipper may secure attachable panel 100 to bag 10 by being located in other areas on carrying bag 10 different than the circumference of bag 10, located in other areas on attachable panel 100 different than the circumference of attachable panel 100, or in any combination of circumference areas and non-circumference areas on bag 10 and attachable panel 100.

In another embodiment, attachable panel 100 may be attached to the front panel 20 of bag 10 using snaps. That is, male sides of snaps may be positioned on the front panel 20 of the bag 10, and female sides of snaps may be positioned in corresponding positions on attachable panel 100 such that when attachable panel 100 is generally aligned in position on front panel 20 of bag 10, the male and female snap components may align and engage to affix panel 100 to front panel 20 of bag 10. It may be preferable that if male sides of snaps are configured on the front panel 20 of bag 10 that female sides of snaps are configured in corresponding positions on attachable panel 100, and that if female sides of snaps are configured on the front panel 20 of bag 10 that male sides of snaps are configured on the attachable panel 20.

As described above, other attachment means may also be used to configure attachable panel 100 to front panel 20 of bag 10 such as latches and grommets, buttons pins, sewing methods, clips, rivets, magnets and other means.

In yet another embodiment, the attachable panel 100 may serve as the complete front panel 20 or as a part of the front panel 20 of the bag 10 such that all or a portion of the attachable panel 100 and all or a portion of the front panel 20 of the bag 10 may be one in the same. That is, a portion or the entirety of front panel 20 of bag 10 may comprise the attachable panel 100 and may be removed and replaced by another front panel 20 with different graphical artwork affixed to it. In this embodiment, the front panel 20 may be attached to the bag 10 with a zipper as described above, Velcro, snaps, clips or other means.

It should be noted that the invention described above may apply to all types of guitar cases and bags including hard cases, soft cases, gig bags, hybrid cases and bags, and other types of guitar bags and cases. Depending on the type of case, it may be preferable that different types of attachment means may be used to affix attachable panel 100 to front panel 20 of case 10. For instance, for soft cases and hybrid cases, Velcro may be used as described above. However, for hard cases made of metal for example, magnets, snaps, latches or other means may be preferable.

It should also be noted that while the descriptions above describe the attachable panel as being attached to the front side 20 of the guitar gig bag 10, the attachable panel 100 may also be attached to other sides or panels of the instrument bag 10 such as the side panel 30, the back panel 40, or to any other panels or sides, or to any combination of panels or sides of carrying case 10, or to any other area on carrying case 10.

Also, while the above descriptions describe a single attachable panel 208 being attached to a carrying case or bag 10, multiple attachable panels may be attached to the carrying case or bag 10 individually or in unison using similar or different means as described above. Said multiple attachable panels may be attached to the front sides, side sides, back sides, or any other sides, regions, areas or combination of sides, regions and areas on the carrying case 10.

In addition, while the description above primarily describes the attachment of attachable panel 100 to a guitar carrying bag or case 10, the attachable panel 100 may be attached to other types of bags meant for carrying other types of instruments. Examples of this may include drum cases, drum stick cases, keyboard cases, horn cases, woodwind cases, violin cases and other types of musical instrument cases.

Also, the attachable panel 100 may be attached to other types of cases and bags that may be designed to carry other items or devices other than musical instruments. Such cases and bags may include laptop computer cases, personal backpacks, messenger bags, tablet computer cases, purses, phone cases, travel cases, sports bags and other types of cases and bags.

Figure 6:
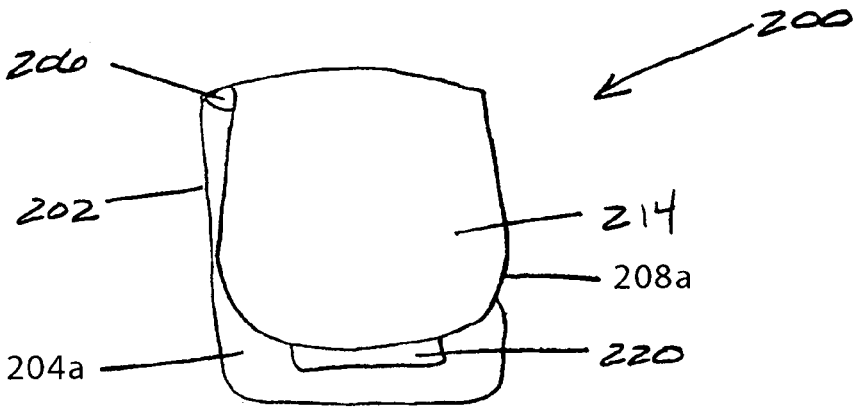
FIG. 6 is a view of the front of a backpack with attachable panel.

In one embodiment of a different type of carrying case or bag that may utilize an attachable panel, a backpack 200 as shown in FIG. 6 may include a body 202, a front side 204*a*, a top opening 206, a front pocket 220, an attachable panel 208*a* and other components. Backpack may also include standard backpack-type straps (not shown) on the back of the bag 200 such that backpack 200 may be worn over the shoulders for hands-free carrying.

Figure 7:
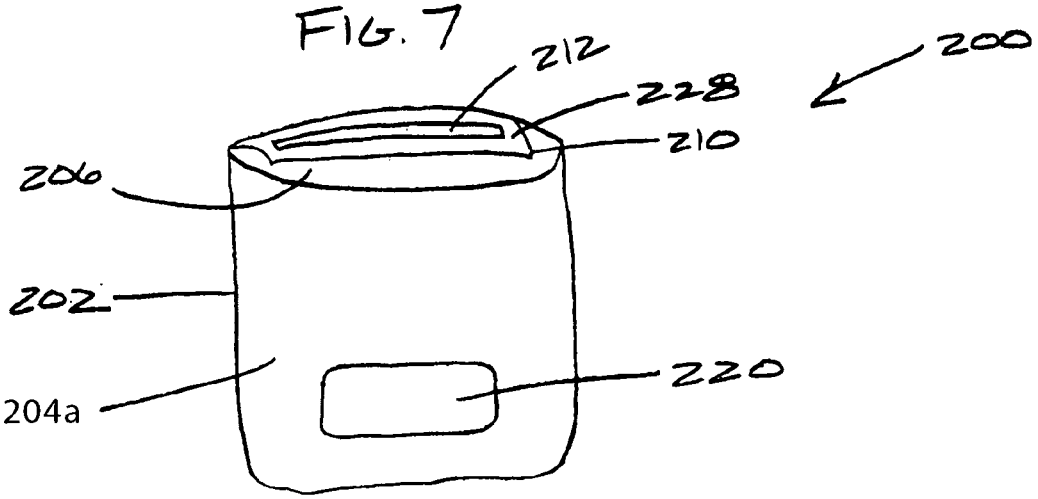
FIG. 7 is a view of the front of a backpack configured to receive an attachable panel but without the attachable panel attached.
Figure 8:
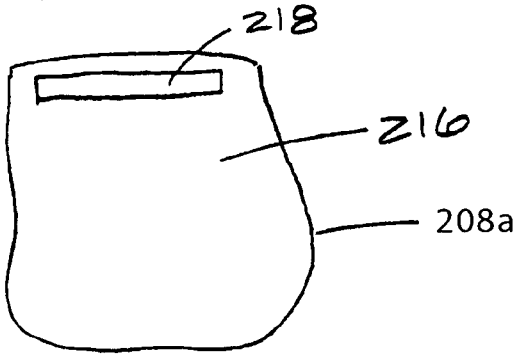
FIG. 8 is a view of the back side of an attachable panel configured for a backpack.

As shown in FIG. 7, backpack 200 may also include a top flap 210. Top flap 210 may include a Velcro section 212 on its outer front side 228 as shown. As shown in FIG. 8, attachable panel 208*a* may include a Velcro section 218 on its back side 216. In a preferred embodiment, Velcro section 212 on flap 210 of backpack 200 may be configured in position, size and shape to receive Velcro section 218 on the back side 216 of attachable panel 208*a*. When Velcro sections 212 and 218 are mated accordingly, attachable panel 208*a* may be configured onto backpack 200 as shown in FIG. 6. It may be preferable that if Velcro section 212 is the hook side of Velcro, that Velcro section 218 may be the loop side of Velcro such that when Velcro section 212 and Velcro section 218 are pressed together that they may affix to each other. Conversely, it may be preferable that if Velcro section 212 is the loop side of Velcro, that Velcro section 218 may be the hook side of Velcro such that when Velcro section 212 and Velcro section 218 are pressed together that they may affix to each other. Pressing Velcro section 218 of attachable panel 208 of FIG. 8 to mate with Velcro section 212 of FIG. 7 may result in backpack 200 configured with attachable panel 208*a* as shown in FIG. 6.

It should be noted that flap 210 may be incorporated into the back side, front side, side sides or other sides of the backpack 200 and may not resemble a flap as shown in FIG. 7. Instead, flap 210 may be a portion of the back side, front side or other sides of the backpack. In this scenario, Velcro section 212 may be located on the back side, front side, side sides or other sides of the backpack 200.

With Velcro section 212 mated and attached to Velcro section 218, attachable panel 208*a* may be configured with backpack 200 and may generally extend from flap 210 over top opening 206 and down over the front 204*a* of backpack 200.

In this configuration, attachable panel 208*a* may act as the top of backpack 200 and may cover top opening 206 of backpack 200. Attachable panel 208*a* may also extend down the front 204*a* of backpack 200 and may or may not cover front pocket 220.

In addition, the lower region of attachable panel 208*a* may be attached or otherwise secured to front side 204*a*, or to other sides of backpack 200, using Velcro, clips, snaps, buckles, straps with buckles, or other attachment means (not shown). With the lower region of attachable panel 208*a* affixed or otherwise secured to the front side 204*a* or other sides of backpack 200 in addition to the upper region of attachable panel 208 being affixed to flap 210 as described above, attachable panel 208*a* may act as a protective cover for backpack 200, thus securing any contents within backpack 200 safely inside. Also, top opening 206 may include additional means to be securely held closed such as a zipper or multiple zippers, snaps, clasps, Velcro sections, a pull chord, latches or other securing means (not shown).

In another embodiment, attachable panel 208*b* may also include upper side flaps 222 that may extend outward on the left and right upper sides of attachable panel as shown in FIG. 9. As shown, Velcro section 218 may extend onto side flaps 222. As described below, side flaps 222 may be used to provide additional strength to the bond between attachable panel 208*b* and upper flap 210 of backpack 200.

To secure attachable panel 208*b* to flap 210 while utilizing side flaps 222, attachable panel 208*b* may first be aligned with flap 210 as shown in FIG. 10. In this position, Velcro section 218 on back side 216 of attachable panel 208*b* may be facing downward while Velcro section 212 on upper flap 210 may be facing upward as shown. Attachable panel 208*b* may then be moved in the direction of arrows A in FIG. 10 until it may overlap upper flap 210 as shown in FIG. 11. In this position, Velcro section 218 may be pressed onto Velcro section 212 such that the two Velcro sections may mate. It may be preferable that if Velcro section 212 may be loop Velcro then Velcro section 218 may be hook Velcro, and that if Velcro section 212 may be hook Velcro then Velcro section 218 may be loop Velcro.

In this embodiment, it may also be preferable that upper flap 210 may have additional back Velcro sections 224 on the general left and right regions on the back side 226 of upper flap 210 as shown in FIG. 12.

In the configuration as shown in FIG. 11, side flaps 222 may be folded over the edges of upper flap 210 until side flaps 222 may come into contact with the back side 226 of flap 210. In this position, it may be preferable that the outer portions of Velcro section 218 on the left and right sides of side flaps 222 may come into contact and may mate with back Velcro sections 224 on the back side 226 of upper flap 210. This is depicted in FIG. 13 and FIG. 14. FIG. 14 is a view looking in the direction of arrows B in FIG. 13.

It may be preferable that if Velcro section 218 is the hook side of Velcro, that Velcro sections 224 may be the loop side of Velcro such that when Velcro section 218 and Velcro sections 224 are pressed together that they may affix to each other. Conversely, it may be preferable that if Velcro section 218 is the loop side of Velcro, that Velcro sections 224 may be the hook side of Velcro such that when Velcro section 218 and Velcro sections 224 are pressed together that they may affix to each other. Pressing Velcro section 218 on the side flaps 222 of attachable panel 208*b* of FIG. 8 to mate with Velcro sections 224 of FIG. 7 may result in attachable panel 208*b* configured with flap 210 as shown in FIG. 13.

It should be stated that this configuration that may include side flaps 222 mated with the underside 226 of flap 210 via mated Velcro sections 218 and 224 may allow attachable panel 208*b* to be attached to upper flap 210 of backpack 200 with increased strength. That is, in this configuration, it may be more difficult for attachable panel 208*b* to be accidentally pulled off from upper flap 210. Removing attachable panel 208*b* from this configuration may require that side flaps 222 may first need to be pulled away from the underneath back side 226 of flap 210 in order to disengage Velcro sections 224 on the back side 226 of flap 210 from the outer areas of Velcro section 218 on the back side 216 on the side flaps 222 of attachable panel 208*b*, and then the attachable panel 208*b* may be pulled off the front side 228 of upper flap 210 in order to disengage Velcro section 218 on the back side 216 of attachable panel 208 from Velcro section 212 on the top side 228 of flap 210.

In addition, attachable panel 208*c* when configured with upper flap 210 may not cover top opening 206 of backpack 200 as shown in FIG. 15. Instead, upper flap 210 may be configured in front of or otherwise to the side of top opening 206 as shown in FIG. 16. Attachable panel 208*c* may be configured and attached to flap 210 using the methods described above, but with flap 210 positioned in front of top opening 206 instead of behind top opening 206, attachable panel 208*c* may not cover top opening 206 when configured with flap 210 of backpack 200 to extend from flap 210 down the front side 204*c* of backpack 200. In this case, top opening 206 may include additional means to be securely held closed such as a zipper or multiple zippers, snaps, clasps, Velcro sections, a pull chord, latches or other securing means (not shown).

Figure 17:
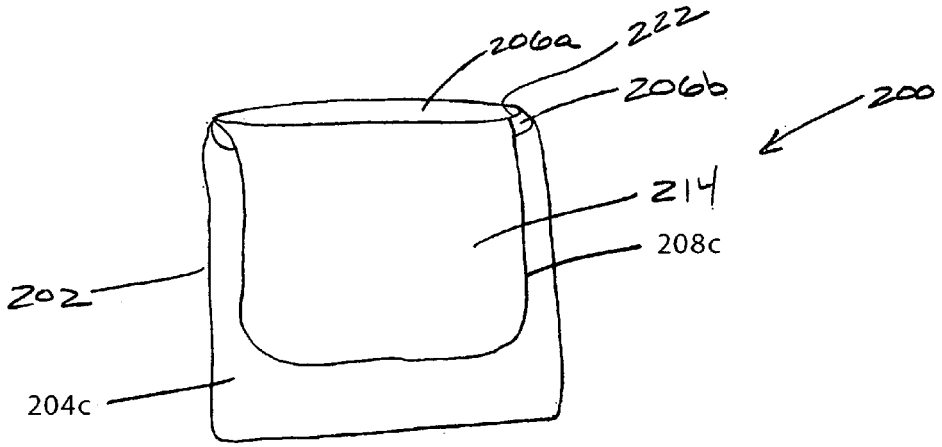
FIG. 17 is a view of a backpack with two top openings with an attachable panel attached in front of the rear top opening and behind the front top opening.

Also, backpack 200 may include multiple top openings 206 and attachable panel 208*c* may be configured to cover all multiple top openings 206, several of multiple top openings 206, one of multiple top openings 206 or no top openings 206. As an example, FIG. 17 depicts backpack with two top openings 206*a*, 206*b* separated by inner wall 222. As shown, attachable panel 208*c* may be attached using attachment means as described above or by other means to the generally upper region of inner wall 222, or to a flap (not shown) configured with the generally upper section of inner wall 222, and may extend over front top opening 206*a* and down the front side 204*c* of backpack 200. In this example, attachable panel 208*c* may not extend over top opening 206*a* since attachable panel 208*c* may be attached to the top of inner wall 222 which may be positioned in front of top opening 206*a*. It may be understood however that if attachable panel 208*c* were attached behind top opening 206*a*, that it may extend over both top opening 206*a* and top opening 206*b* and down the front side 204*c* of backpack 200 (not shown). In addition, it may be understood that if attachable panel 208*c* were attached in front of top opening 206*b*, that it may extend down the front side 204*c* of backpack 200 but not extend over either top opening 206*a* or top opening 206*b*. It will be obvious to someone skilled in the art that this example may be scaled to carrying bags that may include multiple top openings greater in number than two and that attachable panel 208*c* may be configured to cover all multiple top openings, several top openings, one top opening or no top openings, depending on where the upper region of attachable panel 208*c* may be attached to backpack 200.

Another type of carrying bag that may be configured to include an attachable panel may be a type of bag often referred to as a messenger bag 300 as depicted in FIG. 18. As shown, messenger bag 300 may have similar characteristics and elements as backpack 200 described in earlier sections. Specifically, as shown in FIG. 18, messenger bag 300 may have a body 302, a front side 304, a top opening 306, an attachable panel 308, and other components. In addition, messenger bag 300 may also have a shoulder strap 316 to carry messenger bag 300 over the shoulders hands free.

It will be obvious to one skilled in the art that messenger bag 300 may resemble guitar bag 10 and backpack 200 with regards to the current invention such that the descriptions above for how the current invention may be incorporated with guitar bag 10 and backpack 200 may be directly applicable to how the current invention may be incorporated with messenger bag 300. It will also be obvious to one skilled in the art that all of the variations and different configurations described in earlier sections of this specification in regards to guitar carrying case 10 and backpack 200 in relation to the current invention and how an attachable panel may be configured with guitar carrying bag 10 and backpack 200 may also apply to messenger bag 300 such that these variations and configurations need not be repeated here.

Figure 19:
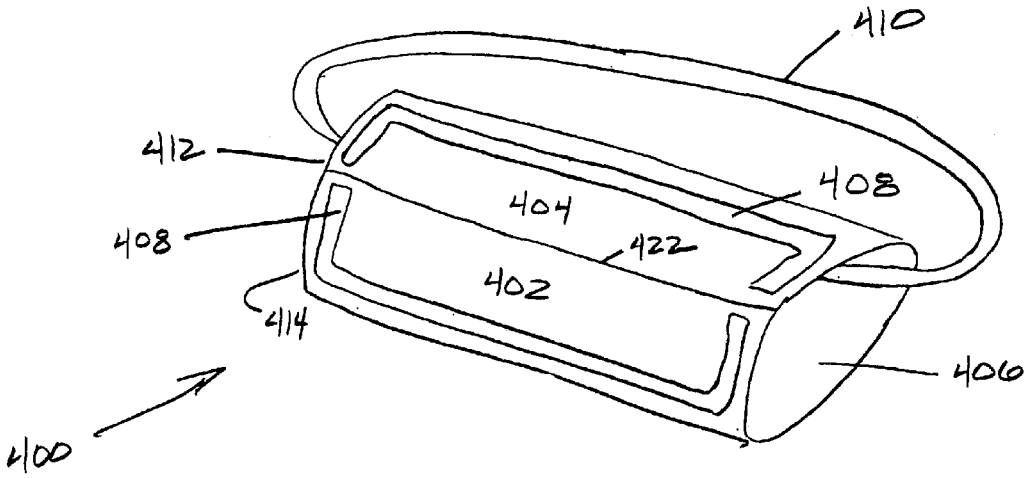
FIG. 19 is a view of a duffle bag configured to receive an attachable panel.
Figure 20:
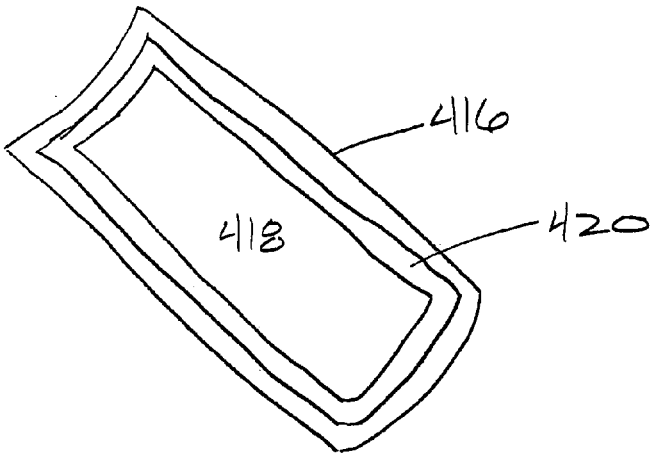
FIG. 20 is a view of an attachable panel configured to be attached to a duffle bag.
Figure 21:
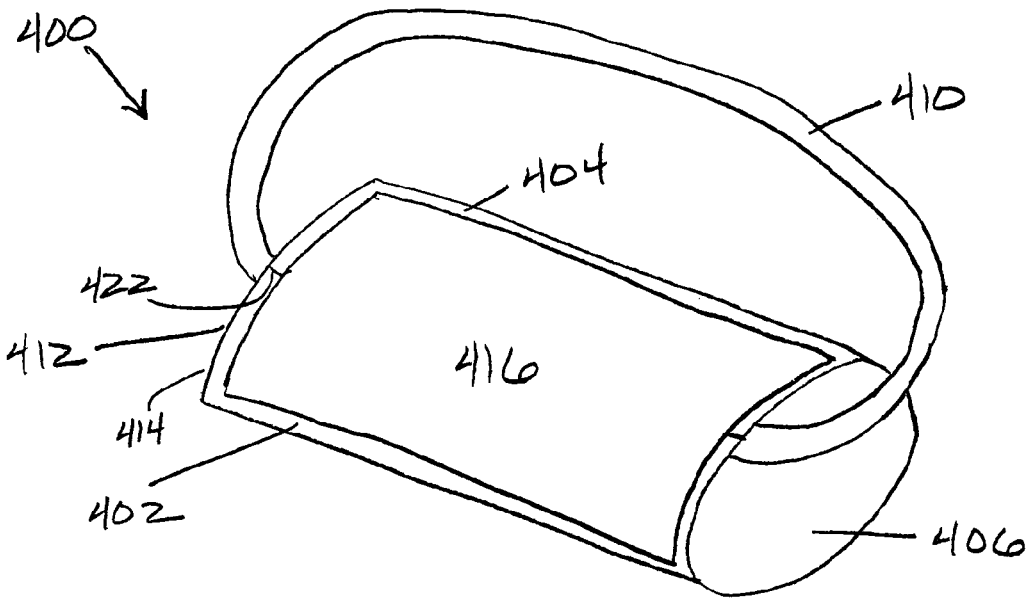
FIG. 21 is a view of a duffle bag with an attachable panel.

Yet another type of carrying bag that may be configured to include an attachable panel may be a duffle bag, often also referred to as a sports bag. As shown in FIG. 19 duffle bag 400 may include body 412, left upper side 402, right upper side 404, zippered top opening 422, front side 406, rear side 414, Velcro section 408 and shoulder strap 410. Similar to descriptions in previous sections in regards to guitar carrying bag 10 with Velcro section 50 on front side 20 in FIG. 1 that may be configured to mate with Velcro section 120 on the back side 110 of attachable panel 100 of FIG. 2, Velcro section 408 on duffle bag 400 may be configured on left upper side 402 and right upper side 404 of FIG. 19 to mate with Velcro section 420 on the back side 418 of attachable panel 416 of FIG. 20. With Velcro section 420 on the back side 418 mated with Velcro section 408 on the upper sides 402, 404 of duffle bag 400, duffle bag 400 of FIG. 21 may result. In the depiction of FIG. 21, attachable panel 416 may be attached to the general upper sides of duffle bag 400 such that graphical artwork (not shown) may be printed or otherwise affixed to the top side of attachable panel 416 to change the graphical design of duffle bag 400.

As shown in FIG. 21, attachable panel 416 may generally cover zippered top opening 422; however, attachable panel 416 may include an opening (not shown) that may allow access to zippered top opening. In addition, attachable panel 416 may include divided attachable panels 416 or multiple attachable panels 416 such that one attachable panel 416 may be attached to left upper side 402 and a second attachable panel may be attached to right upper side 404. In fact, any number of attachable panels 416 may be attached to any number of sides of duffle bag 400 that may or may not cover up zippered top opening 422. While top opening 422 has been described as utilizing a zipper as attachment means to secure top opening 422 closed, other attachment means such as Velcro, snaps, buckles and other attachment means may be used instead. Also, top opening may not utilize any attachment means and attachable panel 416 may or may not assist in holding top opening closed such that the contents within duffle bag 400 may be secure.

It will be obvious to one skilled in the art that all of the variations and different configurations described in earlier sections of this specification in regards to guitar carrying case 10 and backpack 200 in relation to the current invention and how an attachable panel may be configured with guitar carrying bag 100 and backpack 200 may also apply to duffle bag 400 such that these variations and configurations need not be repeated here.

In addition to guitar carrying cases and bags 10, backpacks 200 and duffle bags 300, there are many additional types of carrying bags and cases that may be configured to include attachable panels and therefore be covered by the current invention. The other types of carrying bags or cases may include purses, luggage, business cases, tablet computer cases, smartphone cases, laptop computer cases, computer cases and other types of carrying bags and cases that may have similar or different shapes compared to the guitar case 10, backpack 200 and duffle bag 300 described above, and may be designed to carry other types of items compared to a musical instrument case 10, a backpack 200 or a duffle bag 300, but may include similar elements as the above described guitar bag 10, backpack 200 and duffle bag 300 such as front sides, top sides, side sides, attachment means to attach attachable panels, top openings and other elements such that they too may be configured to include an attachable panel. It will therefore be apparent to one skilled in the art that the entire description above of configuring a guitar case or bag 10, a backpack 200 and a duffle bag 300 with an attachable panel or multiple attachable panels may be applicable to these other types of carrying cases and bags. In addition, these other types of carrying bags and cases may operate in a similar manner with regards to the attachable panel or multiple attachable panels in comparison to the above described guitar carrying bag 10, the backpack 200 and the duffle bag 300 with regards to the attachable panels, for example but not limited to, how to attach an attachable panel to the carrying bag or case, how to remove an attachable panel from the carrying bag or case, how to retrofit an existing carrying bag or case to receive an attachable panel, and other characteristics.

In addition, it will be obvious to one skilled in the art that all of the variations and different configurations described in earlier sections of this specification in regards to guitar carrying case 10, backpack 200 and duffle bag 300 in relation to the current invention and how an attachable panel may be configured with guitar carrying bag 10, backpack 200 and duffle bag 300 may also apply to the additional types of carrying bags and cases such that these variations and configurations need not be repeated here.

In another embodiment, it may be desirable to provide a means to attach the attachable panel 100 to a carrying bag that may not have been designed and manufactured specifically to receive the attachable panel 100. In one example of this scenario, a user may already own a guitar carrying bag that may not have Velcro section 50 attached to its front panel 20. In this case, the means to attach an attachable panel 100 may be provided to the user so that the user may retrofit their existing bag to have the ability to receive attachable panel 100. This may include providing the user with Velcro fastening material or other fastening means that may be affixed to the front panel of their existing instrument bag that may be aligned and mated with Velcro section 120 on attachable panel 100.

In one embodiment, Velcro loop fastening material or Velcro hook fastening material may be provided to the user in strips, patches, or other patterns that may be attached to their existing guitar bags. The provided Velcro sections may be adhesive-backed such that the adhesive backing on the provided Velcro sections may be used to affix the Velcro sections to the users existing bag. The provided Velcro sections may also have heat-activated adhesive means on the back of the sections such that the Velcro may be attached to the existing instrument bag using a heating device such as an iron or other means. Other means such as glue, pins, clips, latches, sewing means, magnets or other means may also be provide to the user to affix the provided Velcro sections to their existing instrument bags. It may be preferable that the fastening means may come with instructions that may guide the user to properly attach the provided fastening means to their existing instrument bag in such a way that the sections may be fixedly attached in the proper locations such that at least some of the fastening means may align with and mate up with corresponding fastening means, if any, on the attachable panel 100. In this way the attachable panel 100 may be removably attached to the user's existing instrument bag as described above.

It may also be preferable that the attachable panel 100 that the user may intend to attach to their retrofitted instrument bag may have a generally similar shape and size of the panel of the existing instrument bag that the user intends to attach it to. To these ends, the manufacturer may provide a number of differently shaped attachable panels 100 that may generally fit a significant number of existing instrument bags that may have been sold prior or are currently on the market. The user may then choose the attachable panel 100 that may most closely resemble the size and shape of the panel on their existing instrument bag that they wish to attach the attachable panel 100 to.

Also, it may not be necessary that the attachable panel 100 generally resemble the size and shape of the existing bag being retrofitted to receive attachable panel 100. In one example of this type, attachable panel 100 may only attach to a portion of a panel on the existing bag. In this case, attachable panel 100 may cover only a portion of the panel, for example the front face of the existing bag, and may therefore be any shape. In this embodiment it may be preferable that attachable panel 100 may fit generally within the entire or a portion of the outer contour of the face on the existing bag that it is to be attached to but this may not be required. It may also be preferable that attachable panel 100 not extend past the outer circumference of the face on the existing back to which it is to be attached to, but this also may not be required. In addition, attachable panel 100 may be modified to fit within the contour of the panel to which it may be attached to by folding, cutting or other modification techniques.

While the fastening means that may be provided to the user to attach to their existing instrument bag described above include Velcro fastening means, other means may be used to attach the attachable panel 100 to the user's existing instrument bag such as pins, snaps, clips, latches, zippers or other means. For instance, when attaching attachable panel 100 to an instrument bag that may not have Velcro sections 50, attachment means other than Velcro fastening means may be utilized. In this application, other means such as clips, pins, snaps, latches or zippers may be provided to attach attachable panel 100 to the existing instrument bag. These alternative fastening means may be attached to the existing instrument bag, to the attachable panel 100, or to both the existing instrument bag and attachable panel 100 such that attachable panel 100 may be attached to and removed from the existing instrument bag in order to replace attachable panel 100 with another panel of different graphical design. These fastening means may remain on the existing gig bag to receive other attachable panels 100, may remain on attachable panel 100, may remain on both the existing gig bag and the attachable panel, or may be removed from the existing gig bag and attachable panel 100 when the panels 100 are exchanged.

It should be noted that if the attachable panel 100 may not adequately resemble the shape and size of the panel of the existing gig bag that the user may be retrofitting to receive and attach to attachable panel 100, means to adjust the size and shape of attachable panel 100 may be provided to the user. These means may include the ability to alter the shape and size of attachable panel 100 by folding, cutting or other means that may alter the shape and size of attachable panel 100.

While the example described above of retrofitting an existing carrying bag that was not originally designed to receive an attachable panel used an instrument carrying bag, specifically a guitar carrying bag, as the example to describe the various elements of the current invention associated with this concept, the elements of the current invention may also pertain to any other type of carrying bag that may be retrofitted to receive an attachable panel. Examples of other types of carrying bags that may be retrofitted to receive an attachable panel may include backpacks, laptop cases, messenger bags, purses, travel bags, business bags, sports bags, duffle bags, luggage and other types of carrying bags and cases.

As stated earlier, graphical artwork may be printed on or otherwise affixed to the front panel 130 of attachable panel 100 using a printing machine, a dye sublimation system, silk screening techniques, paint, decals, stickers or other means.

In one embodiment, the manufacturer of the instrument bag 10 and attachable panels 100 may offer artwork designs, pictures and other types of graphical files that may be chosen by the user to be printed on front side 130 of attachable panel 100. In this embodiment, the attachable panel 100 with the design from the manufacturer affixed to its front side 130 may be available for sale in a retail store, in an online store, through an app or in other places. It should be noted that a variety of attachable panels 100 with a variety of different graphical artwork designs printed or otherwise affixed to their respective front sides 130 may be available by the manufacturer for purchase. It should also be noted that the user may have the ability to purchase an attachable panel 100 with a particular design by itself or with the carrying bag 10 that the attachable panel 100 may be attached to.

In another embodiment, the manufacturer may provide tools for the user to create their own graphical artwork to have printed or otherwise affixed to the attachable panels 100. In one embodiment of this type, the manufacturer may provide a website, an app, software or other types of tools that may allow the user to choose different graphical patterns or images, and may provide the ability for the user to position, size, crop and otherwise manipulate or modify these patterns or images within a template that may resemble the shape of attachable panel 100. The user may then submit the artwork to be printed or otherwise affixed onto an attachable panel 100 to the manufacturer who may print or otherwise affix the artwork to attachable panel 100 and send it to the customer. In addition, the user may perform the above functions without the use of a template that may resemble the shape of attachable panel 100.

In another embodiment of this type, the manufacturer may provide the user with graphical design software that may reside on their website or elsewhere on the Internet, may be provided through the use of a memory device such as a CD, DVD, flash memory device, hard drive memory device or through other means that the user may use to create their own artwork to have printed or otherwise affixed to an attachable panel 100. The manufacturer may also provide the customer with an app or other types of software tools that the user may use to create their own artwork to have printed onto attachable panel 100. The manufacturer may also provide a combination of these different types of tools and functionalities, as well as other types of tools and functionalities to the user that may assist the user to create artwork or pictures that may be printed onto an attachable panel 100.

In another embodiment, the manufacturer of the instrument bag 10 and attachable panels 100 may allow the user to provide their own graphical artwork, pictures, logos, or other media files to the manufacturer to be printed or otherwise affixed to the attachable panel 100. In this scenario, the manufacturer may provide a means for the user to provide to the manufacturer the files to print onto attachable panel 100. Such means may include the ability to upload the graphical artwork files through a website, or while using an app on a mobile device such as a smartphone or tablet computer, or by sending the files by email to the manufacturer, or by other means such that the manufacturer may receive the files and may print or otherwise affix the artwork to the attachable panel 100. The manufacturer may also provide an online template, a template computer file, a physical template or other type of template that may resemble the shape of the attachable panel 100 to the user such that the user may overlay their artwork or picture onto the template in order to position, size, crop and otherwise design and edit their artwork to be printed or otherwise affixed to the attachable panel 100. Other means that may be used to allow the user to provide their own artwork to the manufacturer may include FTP, Cloud computing file storage means, files sent to the manufacturer on physical media storage devices such as flash drives or DVDs, or other means.

In addition, means for a customer to upload or otherwise provide the manufacturer of carrying bag 10 with graphical artwork to print or otherwise affix to attachable panel 100 may be provided to the customer at a retail point of purchase of carrying case 10 and attachable panel 100 such as within a retail store or other vendor. In this scenario, the retail store may provide an interactive display that may include an input device that may allow the customer to upload or otherwise provide the graphical artwork or pictures to the manufacturer to print onto attachable panel 100. The customer may be able to transfer their artwork or pictures from their smartphone, tablet computer, memory device or other type of device to the interactive display such that the interactive display may then provide the artwork or pictures to the manufacturer of attachable panel 100. Such interactive display may include a tablet computer or other type of input device as well as software, apps or other applications. The retail store may also provide means for the customer to download or otherwise load an app to their own mobile device to use that may allow the customer to transfer the artwork or picture files from their own mobile device or other device to the manufacturer of attachable panels 100. In addition, the customer may simply download the app from a website or acquire the app from another source in order to use the app to transfer the artwork or picture files to the manufacturer of attachable panels 100. The manufacturer may then print or otherwise affix the artwork or picture files to the attachable panel 100 for the customer and send it to the customer in the mail, send it to the retail point of purchase for the customer to pick up, or otherwise provide the printed attachable panel 100 to the customer by other means. In this scenario, the customer may have the ability to purchase the carrying bag 10 and the attachable panel 100 from the retail store and may leave the store with the carrying bag 10 with or without an attachable panel 100, in which case the customer may be provided with the attachable panel 100 at a later time by other means.

The interactive display that the customer may use to upload or otherwise provide their artwork or pictures to the manufacturer of attachable panels 100 in order to print or otherwise affix to attachable panels 100 may also keep track of the store and sales information (name of store, location of store, items ordered, total sale value, and other information) such that the store may get credit for the sale of the customized attachable panel 100. This information may be useful to the manufacturer of attachable panels 100 in order to know the sales performance of the various stores that may be providing this service. This information may also be used to provide payments or incentives to the stores that make the sales for the manufacturer.

In another embodiment, artists, designers or other creative types of people may provide their artwork for customers to have printed or otherwise affixed to the front sides 130 of their attachable panels 100. In this embodiment, an artist may provide artwork to the manufacturer using means similar to described above, and the manufacturer may offer the artwork to their customers to have printed or affixed to the attachable panels 100. This embodiment may also include a sales commission that may be paid to the artist who may have provided artwork, payable when a customer may choose and order to have that specific artwork printed or otherwise affixed to their attachable panel 100. In this scenario, commissioned artists may be incentivized to market their attachable panel and carrying bag designs to their own network of fans such that the manufacturer of attachable panels 100 may also benefit from this marketing. Artist may also receive for hire payments without a sales commission, or a combination of for hire payments and sales commissions.

In yet another embodiment, companies or other entities may provide the manufacturer of the carrying bag 10 and attachable panel 100 with artwork that may be printed or affixed to the attachable panels 100 that may be used for advertising or marketing purposes. That is, a company may provide graphical artwork to the manufacturer of the instrument bag 10 and attachable panel 100 that may advertise the company's products or services in an aesthetically pleasing way such that a user may wish to have the graphical advertisement printed or affixed to an attachable panel 100 that may be affixed to their carrying bag 10. In this way, the user may carry the bag for others to see, and the advertisement printed on the front side 130 of the attachable panel 100 on their carrying bag 10 may provide valuable advertising for the company. In this embodiment, the company providing the advertisement graphical artwork may not only provide the artwork to the manufacturer of the bag 10 and attachable panel 100, but may also pay the manufacturer an added fee for providing the advertising means.

As stated above, graphical artwork may be printed or otherwise affixed to attachable panel 100, 208, 308 using a variety of techniques such as hand painting, silk screening, dye sublimation and other techniques.

In the case of dye sublimation, the artwork may first be printed onto paper using a dye sublimation printer. The graphical artwork may then be transferred from the printed paper to the attachable panel 100, 208, 308 by placing the paper face down onto the side of the attachable panel 100, 208, 308 that may receive the artwork, and then pressing the artwork paper and attachable panel 100, 208, 308 together at an elevated temperature and at a desired pressure to effectively melt the ink on the artwork paper and transfer the graphical image to attachable panel 100, 208, 308. It may be preferable that attachable panel 100, 208, 308 be made of a high percentage of Polyester such that the dye sublimation process may be more effective.

However, this dye sublimation process may be typically designed to work with transferring graphical images from printed artwork paper as described above to a nominally flat substrate such as a flat piece of Polyester canvas, a flat sheet of metal, a flat piece of wood, or other nominally flat substrates. The reason for this is that the dye sublimation process may be most effective in producing a consistent and well printed image when there is even and constant pressure and temperature applied across the entire printed paper and substrate combination.

Figure 22:
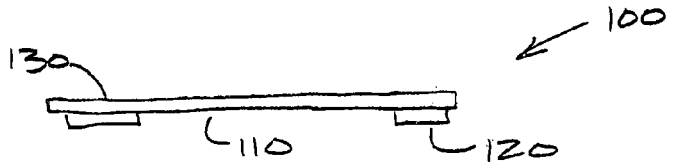
FIG. 22 is a side view of an attachable panel with Velcro sections.

In the case of attachable panel 100, 208, 308, 416 the standard dye sublimation process may have a problem uniformly transferring the graphical images printed on the artwork paper to attachable panel 100, 208, 308, 416 due to Velcro section 120, 218, 408 that may be sewn onto attachable panel 100, 208, 308, 416. Velcro section 120, 218, 420 that may be sewn onto attachable panel 100, 208, 308, 416 may cause attachable panel 100, 208, 308, 416 to not be nominally flat, but instead may cause attachable panel 100, 208, 308, 416 to have raised sections due to Velcro section 120, 218, 420 in the areas where Velcro section 120, 218, 420 may be sewn onto attachable panel 100, 208, 308, 416. FIG. 22 depicts this for the case of attachable panel 100 looking in the direction of arrows C of FIG. 2. This in turn may cause the dye sublimation process to have uneven pressure and temperature across the entire surface of attachable panel 100, 208, 308, 416, specifically in the areas immediately surrounding the raised areas that may be due to Velcro section 120, 218, 420. In this case, the image being printed onto attachable panel 100, 208, 308, 416 may have inconsistencies in these areas. It should be noted that it may be preferable that Velcro section 120, 218, 420 be sewn onto attachable panel 100, 208, 308, 416 before the dying process such that the thread or other means used to sew or otherwise affix Velcro section 120, 218, 420 to attachable panel 100, 208, 308, 416 may be covered by the graphical artwork that may be printed onto attachable panel 100, 208, 308 416. It may be preferable that if thread may be used to sew Velcro section 120, 218, 420 to attachable panel 100, 208, 308, 416, that the thread may be Polyester thread such that the dye sublimation process may print more effectively on the thread. If Velcro sections 120, 218, 420 were sewn onto attachable panel 100, 208, 308 after the graphical artwork was transferred to attachable panel 100, 208, 308, 416, the thread may cover up the artwork that may have been printed onto attachable panel 100, 208, 308, 416 in the areas where the thread may have been used to sew Velcro section 120, 218, 420 to attachable panel 100, 208, 308, 416 which may be unsightly and less preferable.

Figure 23:
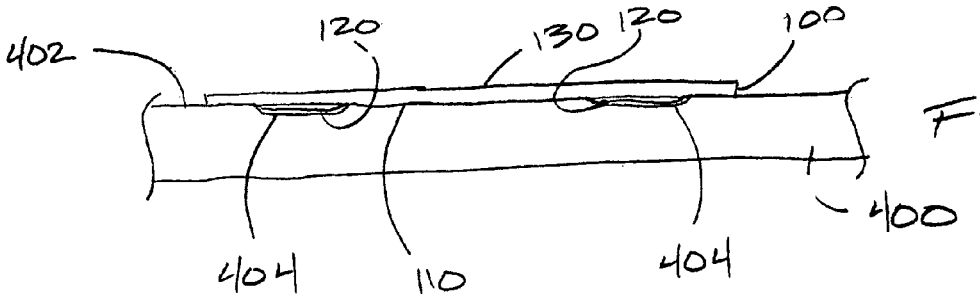
FIG. 23 is a side view of an attachable panel with Velcro sections pressed into a pad on a dye sublimation system.

FIG. 23 depicts one embodiment that may solve this dye sublimation problem of attachable panel 100, 208, 308, 416 having raised sections as described above. As shown in FIG. 22, a soft pad 400 may be placed underneath attachable panel 100, 208, 308, 416 with Velcro section 120, 218, 420 resting against the top surface 402 of pad 400 such that when pressed with printed artwork paper as described above at a desired pressure and elevated temperature, Velcro section 120, 218, 420 may be pressed into top surface 402 of pad 400 and may create small indentations 404 in top surface 402 of pad 400. This may effectively allow top surface 130 of attachable panel 100, 208, 308 to be nominally flat such that the pressure and temperature may be more consistent across the entire top surface of attachable panel 100, 208, 308, 416 such that the dye sublimation process may be more effective resulting in a higher quality graphical image.

Because each attachable panel 100, 208, 308 may be printed individually and then configured onto a carrying bag as described above, the manufacturer of carrying bags with attachable panels may not need to hold inventory of any particular graphically designed attachable panel. That is, the manufacture may only need to carry inventory of carrying bags that may be configured to receive and be configured to an attachable panel, and blank ready-to-print attachable panels that may be configured to the carrying bags. Note that the manufacturer may carry inventory of a single type of carrying bag along with attachable panels that may be configured to fit onto the single type of carrying bag, or the manufacturer may carry inventory of multiple types of carrying bags along with multiple types of attachable panels, with each type of attachable panel configured to fit onto its respective particular type of carrying bag in inventory. Then, upon an order from a customer for a particular type of carrying bag with an attachable panel containing a particular graphical design on the attachable panel, the manufacturer may print the desired particular graphical design onto the applicable blank attachable panel made for the type of carrying bag being ordered by the customer, mate the attachable panel that has been printed with the desired graphical design to the ordered carrying bag, and ship the ordered carrying bag with the mated attachable panel containing the desired graphical design to the customer.

This is in stark contrast to printing graphical designs directly onto a permanent side or multiple permanent sides of a carrying case, in which scenario the graphical designs may be a permanent element of the carrying case. In this scenario of permanent designs printed onto permanent sides of a carrying case, the manufacturer of such carrying cases may need to carry inventory of said cases as it may not be possible or financially feasible to create each carrying case individually with particular graphics on permanent sides of the carrying case. In most cases, manufacturers of carrying cases may have a minimum order quantity requirement of hundreds if not thousands of units of a particular design in order to be able to produce the product at a reasonable cost. Producing higher volume of identical graphical designed units may result in a lower and more reasonable cost per unit, and because of this, a factory may only manufacture orders of a particular graphical design if the quantity ordered is at least the minimum quantity required. This may force a manufacturer that wishes to sell carrying bags with permanent graphical sides to produce the minimum order quantity of a particular graphical design or designs in hopes that these graphical designs will be popular and will sell through.

If a manufacturer is forced to carry inventory on carrying bags with permanent graphics printed onto permanent sides of the carrying bags, the manufacturer may be at risk of the bags not being popular and not selling, or of the graphical designs falling out of popularity before the entire inventory of a particular graphical design has been sold. In these cases, the manufacturer may be forced to liquidate the unsellable inventory at a financial loss.

However, because the manufacturer that wishes to sell carrying bags with attachable panels does not need to carry inventory of a particular graphical design to be printed onto the attachable panels, the company in this scenario does not need to produce minimum quantity orders of a particular graphical design. The company only needs to produce minimum order quantities of the carrying bags configured to receive attachable panels as described above, along with minimum order quantities of blank ready-to-print attachable panels. Since these carrying bags may not contain any graphics on them, they are not in danger of falling out of style due to a graphical design, and the manufacture may not be forced to liquidate them at a financial loss.

In fact, the manufacturer of carrying bags or cases with attachable panels is able to produce particular graphically designed carrying bags and cases that may be popular on one day, and upon those graphical designs falling out of popularity, may be able to produce new and entirely different graphically designed carrying cases and bags on another day simply by choosing a new digital artwork file to print. Because the graphical designs may be digital artwork files on a computer that may be printed onto blank attachable panels whenever desired, an entire library of designs may be created and offered to the public for sale, and then printed onto blank attachable panels when ordered by a customer without having to ever carry physical inventory of any of the printed designs. This may eliminate significant financial risk compared to having to carrying physical inventory of any carrying bags with permanent graphical designs.

In addition, as described above, customers may design their own graphical designs to be printed onto the attachable panels. By producing carrying bags and cases with attachable panels instead of carrying bags with permanent graphical designs on permanent sides of the carrying case, the manufacturer may be able to print the customer's graphical design onto the attachable panel, configure the printed attachable panel onto the desired carrying bag and fulfill the order to the customer at a reasonable cost. In this scenario, the customer's graphical design may be a digital file similar to any other digital file that the manufacturer may have of any other graphical design, and thus may be printed onto a blank ready-to-print attachable panel upon the customer's order. This manufacturing process is sometimes referred to a "just in time manufacturing" or "to order manufacturing". Conversely, if the manufacturer were manufacturing carrying bags with permanent graphics printed onto permanent sides of the carrying bags, it may not be possible or financially feasible for the manufacturer to print the customer's designed graphics onto the permanent sides of the carrying bags at a reasonable cost.

As described above, the sales revenue methods of the present invention may include online sales of carrying bag 10 and attachable panel 100 either together or separate, brick-and-mortar retail store sales of instrument bag 10 and attachable panel 100 either together or separate, selling in-house designed attachable panels 100, selling attachable panels 100 designed by other artists, selling attachable panels 100 with designs created by customers, selling attachable panels 100 with designs created by customers using tools provided by the manufacturer, selling advertising space on the attachable panels, and other methods.

The present invention includes a number of aspects and features which may be practiced alone or in various combinations or sub-combinations, as desired. While preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A carrying bag configured to carry items, comprising:
a top opening with a top edge;
an attachment flap configured with the top edge of the top opening and having a first surface with attachment means and a second surface with attachment means opposite the first surface;
a detachable panel with side flaps;
wherein the detachable panel and the side flaps have attachment means;
wherein the attachment means on the detachable panel and the side flaps extends continuously across the side flaps and the detachable panel; and
wherein the detachable panel is attached to the first surface of the attachment flap and the side flaps are attached to the second surface of the attachment flap.

2. The device of claim 1, wherein the attachment means are hook and loop material.

3. The device of claim 1, wherein the detachable panel extends over the top opening of the bag and serves as a top cover to the bag.

4. The device of claim 1, wherein the detachable panel extends over the front of the bag and serves as a front cover to the bag.

5. The device of claim 4, wherein at least a portion of the front of the bag includes attachment means; and
at least a portion of the detachable panel that extends over the front of the bag includes attachment means;
wherein the attachment means on the detachable panel engage the attachment means on the front of the bag to secure the detachable panel to the bag.

6. The device of claim 1, wherein the detachable panel comprises graphical artwork or pictures on its outer side.

7. A carrying bag configured to carry items, comprising:
a top opening with a back edge and a front edge; and
an attachment flap configured with and extending from the back edge of the top opening and having a first surface with attachment means and a second surface with attachment means opposite the first surface; and
a detachable panel with left and right side flaps;
wherein the detachable panel and the side flaps have attachment means; and
wherein the attachment means on the detachable panel and the side flaps extend continuously from the left side flap to the detachable panel to the right side flap; and
wherein the detachable panel is attached to the first surface of the attachment flap and the left and right side flaps are attached to the second surface of the attachment flap.

8. The device of claim 7, wherein the attachment means are hook and loop material.

9. The device of claim 7, wherein the detachable panel extends over the top opening of the bag and serves as a top cover to the bag.

10. The device of claim 7, wherein the detachable panel extends over the front of the bag and serves as a front cover to the bag.

11. The device of claim 10, wherein at least a portion of the front of the bag includes attachment means; and
at least a portion of the detachable panel that extends over the front of the bag includes attachment means;
wherein the attachment means on the detachable panel engage the attachment means on the front of the bag to secure the detachable panel to the bag.

12. The device of claim 11, wherein the attachment means on the detachable panel and the front of the bag comprise hook and loop material.

13. The device of claim 7, wherein the detachable panel comprises graphical artwork or pictures on its outer side.

* * * * *